US008991372B2

(12) United States Patent
Pirillo

(10) Patent No.: US 8,991,372 B2
(45) Date of Patent: Mar. 31, 2015

(54) PORTABLE DEVICE TO COMPRESS BOWS

(71) Applicant: Maria Alejandra Pirillo, Villa Martelli-Pcia de Buenos Aires (AR)

(72) Inventor: Maria Alejandra Pirillo, Villa Martelli-Pcia de Buenos Aires (AR)

( * ) Notice: Subject to any disclaimer, the term of this patent is extended or adjusted under 35 U.S.C. 154(b) by 0 days.

(21) Appl. No.: 13/683,608

(22) Filed: Nov. 21, 2012

(65) Prior Publication Data

US 2013/0125871 A1 May 23, 2013

(30) Foreign Application Priority Data

Nov. 22, 2011 (AR) ..... P110104334
Nov. 20, 2012 (AR) ..... P120104357

(51) Int. Cl.
*F41B 5/14* (2006.01)

(52) U.S. Cl.
CPC ..... *F41B 5/1449* (2013.01)
USPC ..... 124/1; 124/86

(58) Field of Classification Search
USPC ..... 124/1, 23.1, 80, 86; 254/399
See application file for complete search history.

(56) References Cited

U.S. PATENT DOCUMENTS 115,450 A * 5/1871 Doty ..... 254/399
903,433 A * 11/1908 Baker ..... 188/65.1
1,422,174 A * 7/1922 Boettcher ..... 254/391
4,074,409 A * 2/1978 Smith ..... 29/446
4,195,397 A * 4/1980 Saunders ..... 29/235
5,125,389 A 6/1992 Paff
5,425,350 A 6/1995 Egusquiza
5,957,120 A 9/1999 Wiseby et al.
6,957,647 B2 10/2005 Evans et al.
7,089,923 B2 8/2006 Johnson
7,913,680 B2 3/2011 Evans
2004/0129260 A1 7/2004 Evans
2004/0194770 A1 10/2004 Johnson

* cited by examiner

*Primary Examiner* — John Ricci
(74) *Attorney, Agent, or Firm* — Ladas & Parry LLP

(57) ABSTRACT

A portable device to compress a bow comprising a pulley system with a block and tackle and fixed pulleys which, by wiring, are connected to a set of fastening supports with fastening ends. The fastening ends fasten and pull the ends of the arms or limbs of a bow, under traction exerted by the block and tackle. The block and tackle has a drive portion and a brake controlling the traction and release of the cables connected to the fastening supports. Upon pulling the drive portion, the block and tackle produces the approach between the first and the second pulleys. This displacement between the pulleys acts on the cables which, through the fixed pulleys, cause the approach between the fastening supports. This displacement of the fastening supports overcomes the resistance of the bow and compresses it. Once the desired compressive level is reached, the brake or blockage is actuated.

15 Claims, 8 Drawing Sheets

PORTABLE DEVICE TO COMPRESS BOWS

TECHNICAL FIELD

The present invention is related to the field of weapons, and within this field, to accessories for arrow bows.

More particularly, it comprises a portable device to compress bows, which fastens to the ends of the bow, and, by means of a drive portion, combined with a pulley system and a brake, to compress a bow easily, to perform different tasks, and also to release it easily.

BACKGROUND

As it is known, the use of bows to throw arrows constitutes a widely spread practice, within the sport field as well as for recreation.

Its spreading has allowed the evolution of the bows, to such extent that nowadays, the so-called compound bows are used, which technical and functional evolution is still under development. Therefore, today, traditional bows, with a simpler structure, as well as compound bows with a more complex structure, are used.

In all cases, it is a frequent need to perform maintenance, adjustment and/or repair tasks, such as string, bus wire or yoke wire removal or replacement, removal or replacement of elements such as cord-keeper, pulleys, replacement of limbs, as well as further operations.

Up to now, different devices intended to compress bows are known. For example, the patent U.S. Pat. No. 5,125,389 is based on a pulley accessory, through which a screw works with a crank, resulting in a very slow and difficult to handle device, especially if it is taken into account that many turns must be performed for small tension adjustments.

The patents U.S. Pat. No. 5,425,350, U.S. Pat. No. 6,957,647 and US 20040129260 show devices based on structures that work on threaded elements, with similar disadvantages to those of the above mentioned case.

The patent U.S. Pat. No. 5,957,120 discloses a device that uses a mechanism based on gear teeth, cramps and springs.

The patents U.S. Pat. No. 7,089,923 and US 20040194770 show apparatuses using adjustment devices.

The patent U.S. Pat. No. 7,913,680 shows a device based on a clamping mechanism which also utilizes threaded parts.

BRIEF SUMMARY

A portable device is described that may be easily carried and be used in any place or situation.

The device is much simpler to place on the bow than any other device known, because it is placed and adjusted just by pulling from an end.

The device can compress and disassemble completely, and reassemble, to practically all the known bows, either the traditional or the compound.

The device may be easily operated by only one person, without the need of support.

The device is much easier on the equipment, because, neither the pulleys, nor the ends damage the surfaces, as it usually happens with the devices having means such as steel wires, chains, metallic structures, etc.

Although it is a portable, relatively small and light device, the device can carry out the same tasks for which bench or fixed installation devices are used.

If necessary, the device may be repaired or changed without the need of tools.

The device can operate directly on the point of application of the force, as pulleys do, without the risk that the limbs work in a manner different from that which they were intended for.

The device is a very quick device, as it may not be necessary to be screwed or unscrewed.

Besides being portable, the device may be conditioned, so that it occupies a reduced space.

BRIEF DESCRIPTION OF THE DRAWINGS

For better clearness and understanding of the portable device, it is illustrated in several drawings wherein it has been represented in one of its embodiments, in an illustrative manner but without limitation.

In all cases, it is observed how the end and the fingers achieve a suitable fastening of the ends of the bow.

Figure 1:
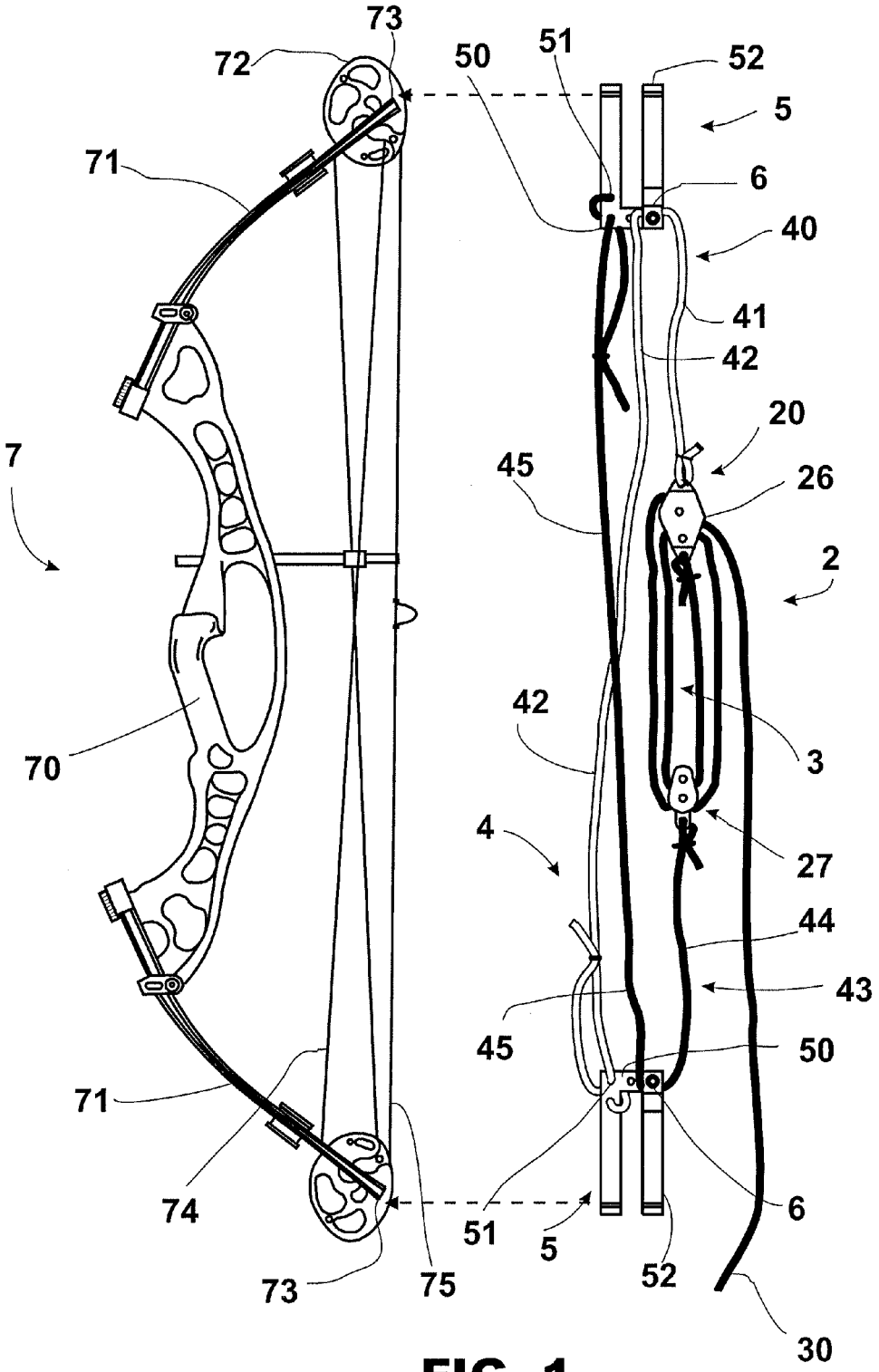
FIG. 1 is a front elevated view of the device. On one side, in a side elevated view, a compound bow to which the present device can be applied is shown.
Figure 2:
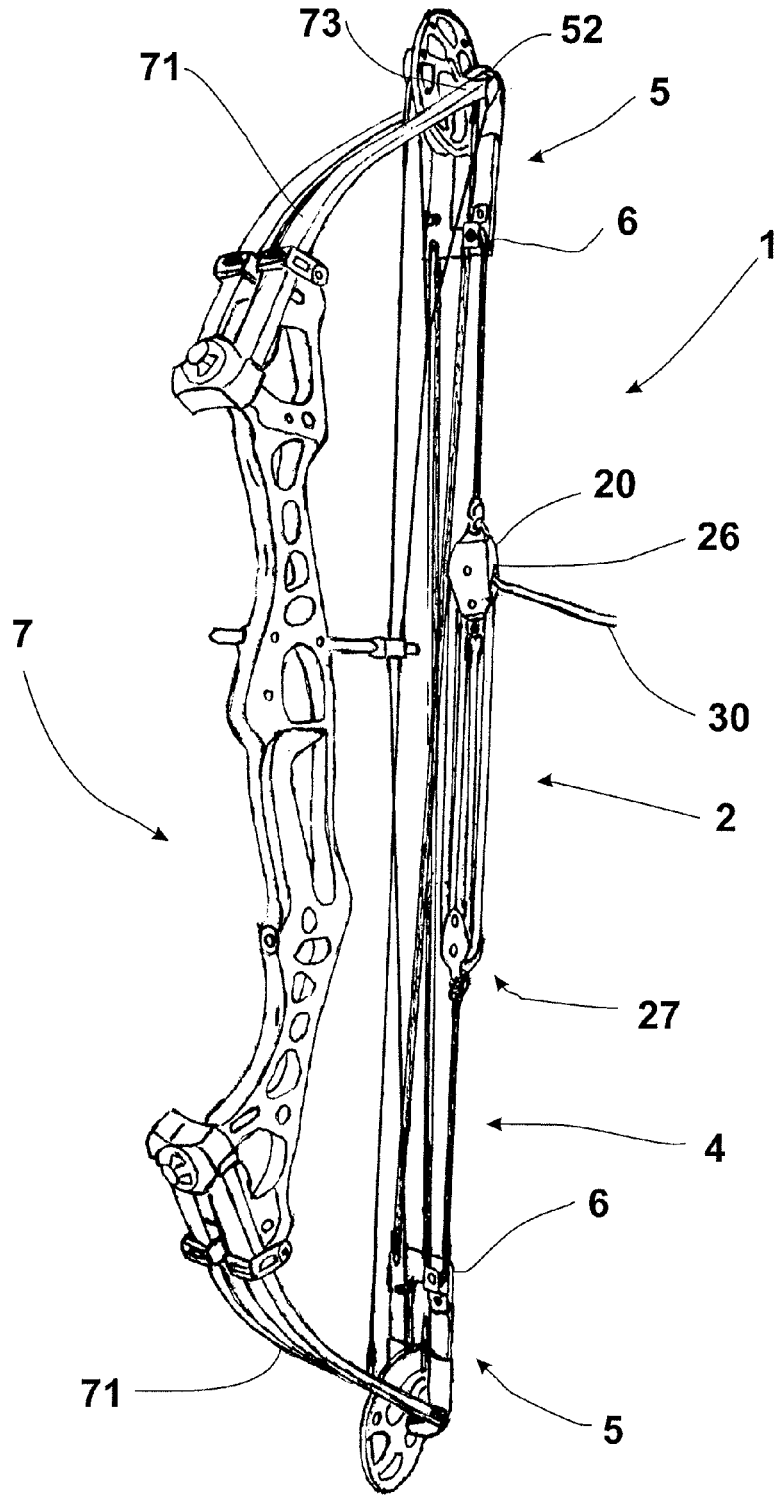
FIG. 2 is a perspective view with the device applied to a compound bow.
Figure 4:
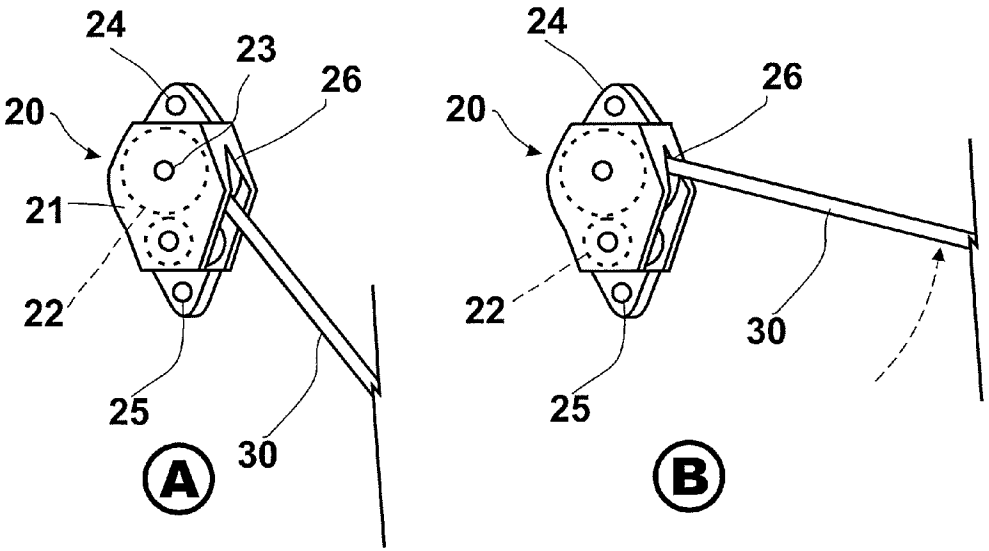
FIG. 4A is a perspective view of the first pulley of the block and tackle, wherein the inner wheels are marked with a discontinuous line, and wherein, laterally, the brake or blockage of the drive portion can be seen.
FIG. 4B is another perspective view wherein it is shown how the drive portion enters the brake or blockage.
Figure 5:
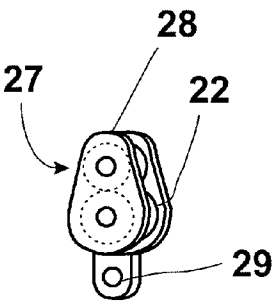
FIG. 5 is a perspective view of the first pulley of the block and tackle wherein the inner wheels are marked with a discontinuous line.
Figure 3:
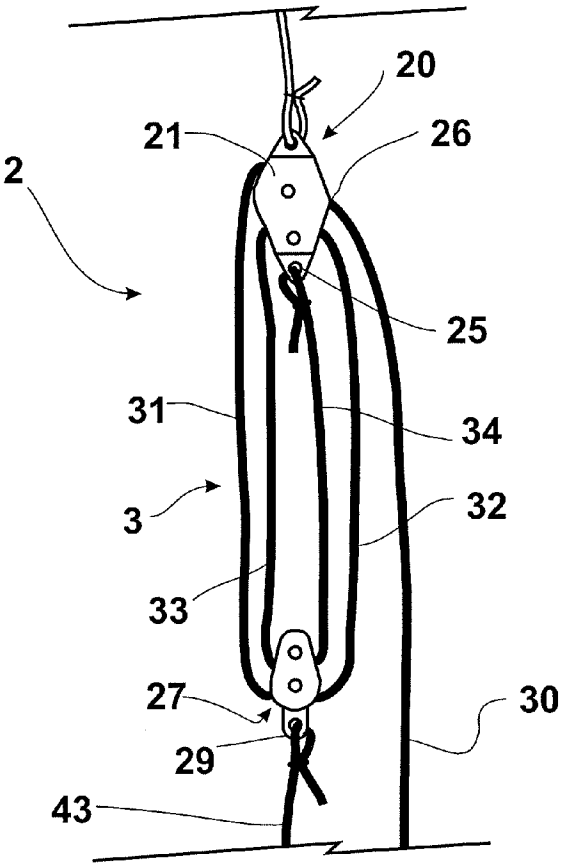
FIG. 3 is a front, elevated view of the block and tackle integrating the pulley system of the present device.
Figure 6:
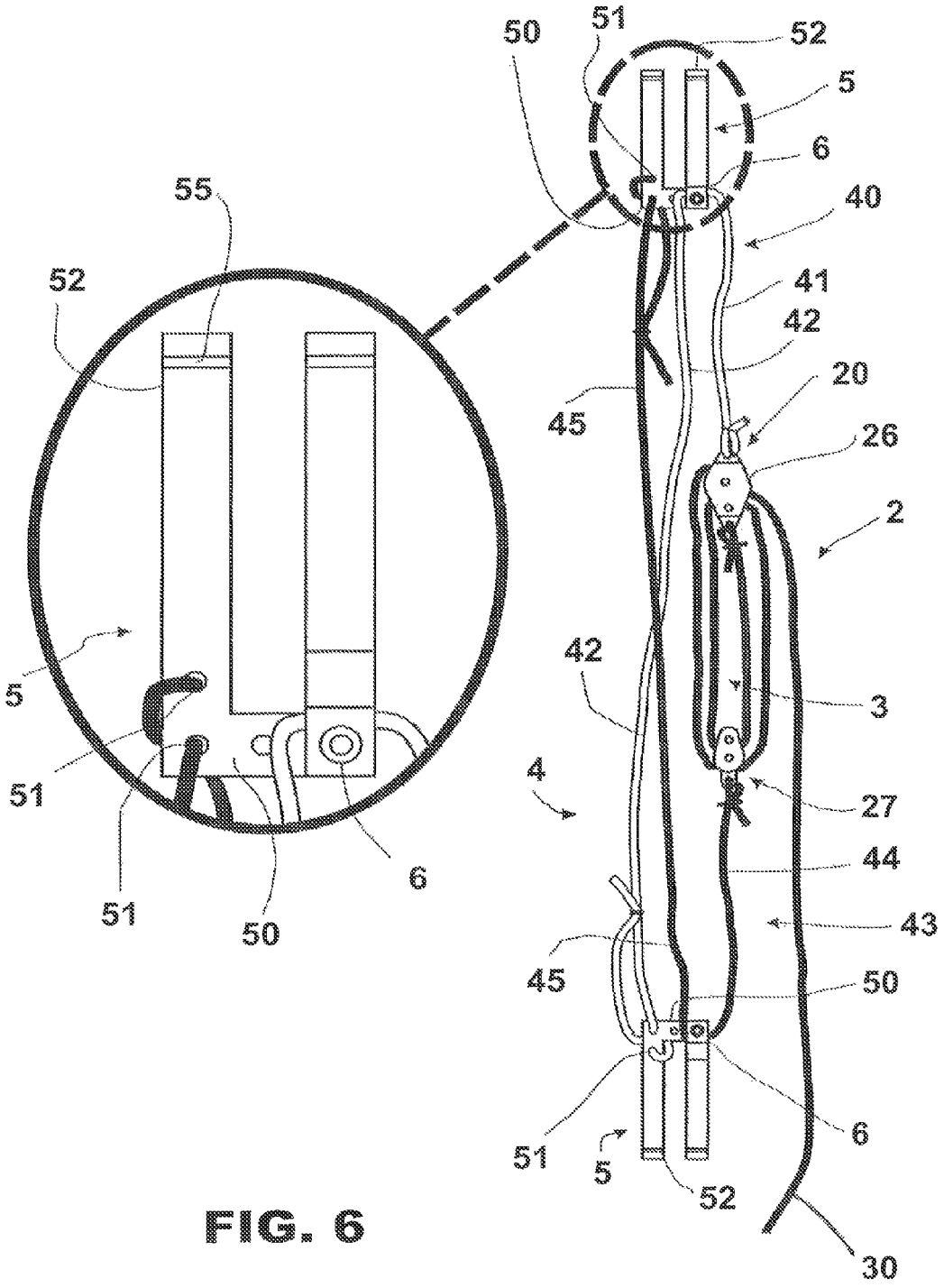
FIG. 6 is a front, elevated view of the present device with an enlarged detail of one of the fastening supports.
Figure 7:
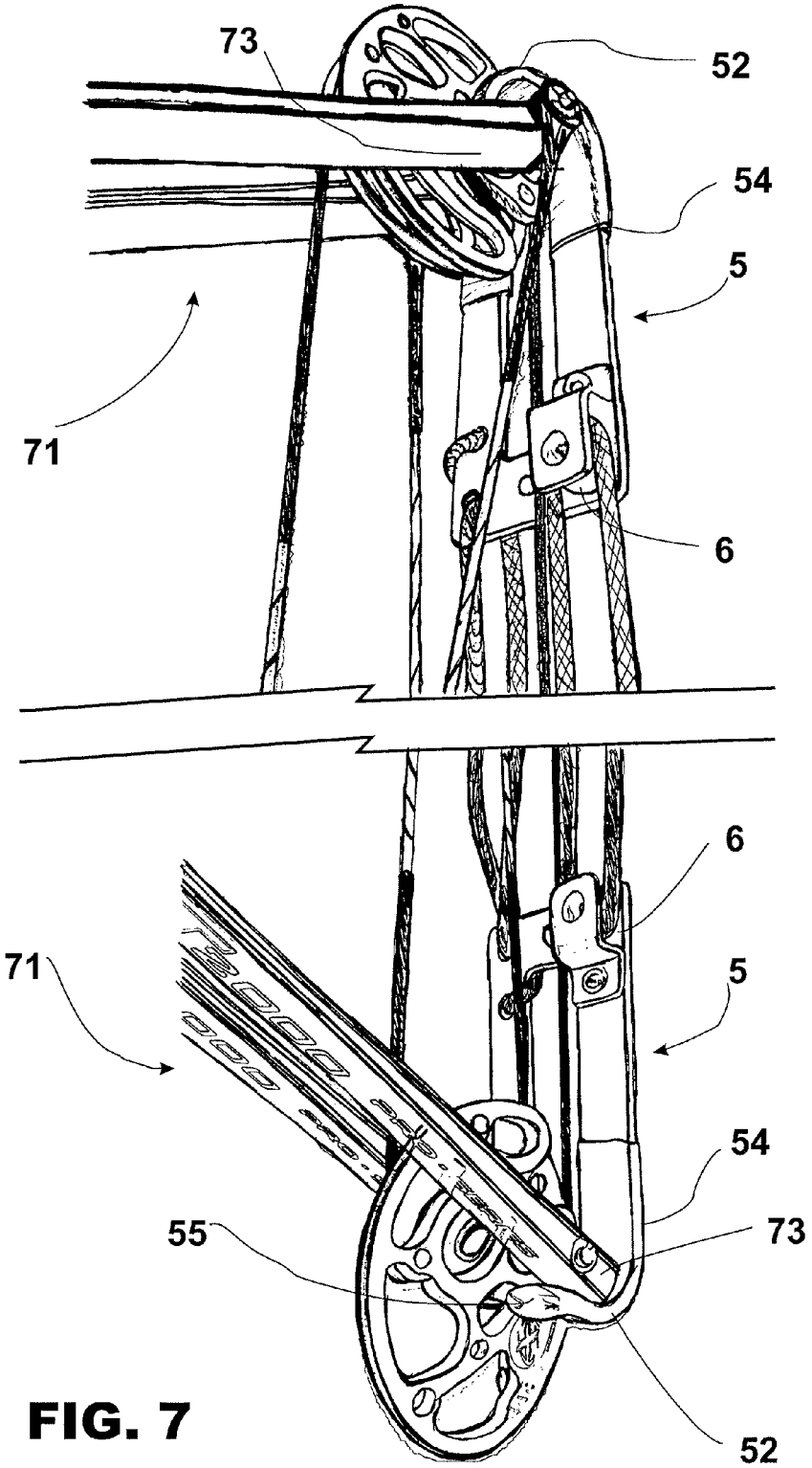
FIG. 7 is a perspective view of the tow fastening supports applied to the ends of the bow.
Figure 8:
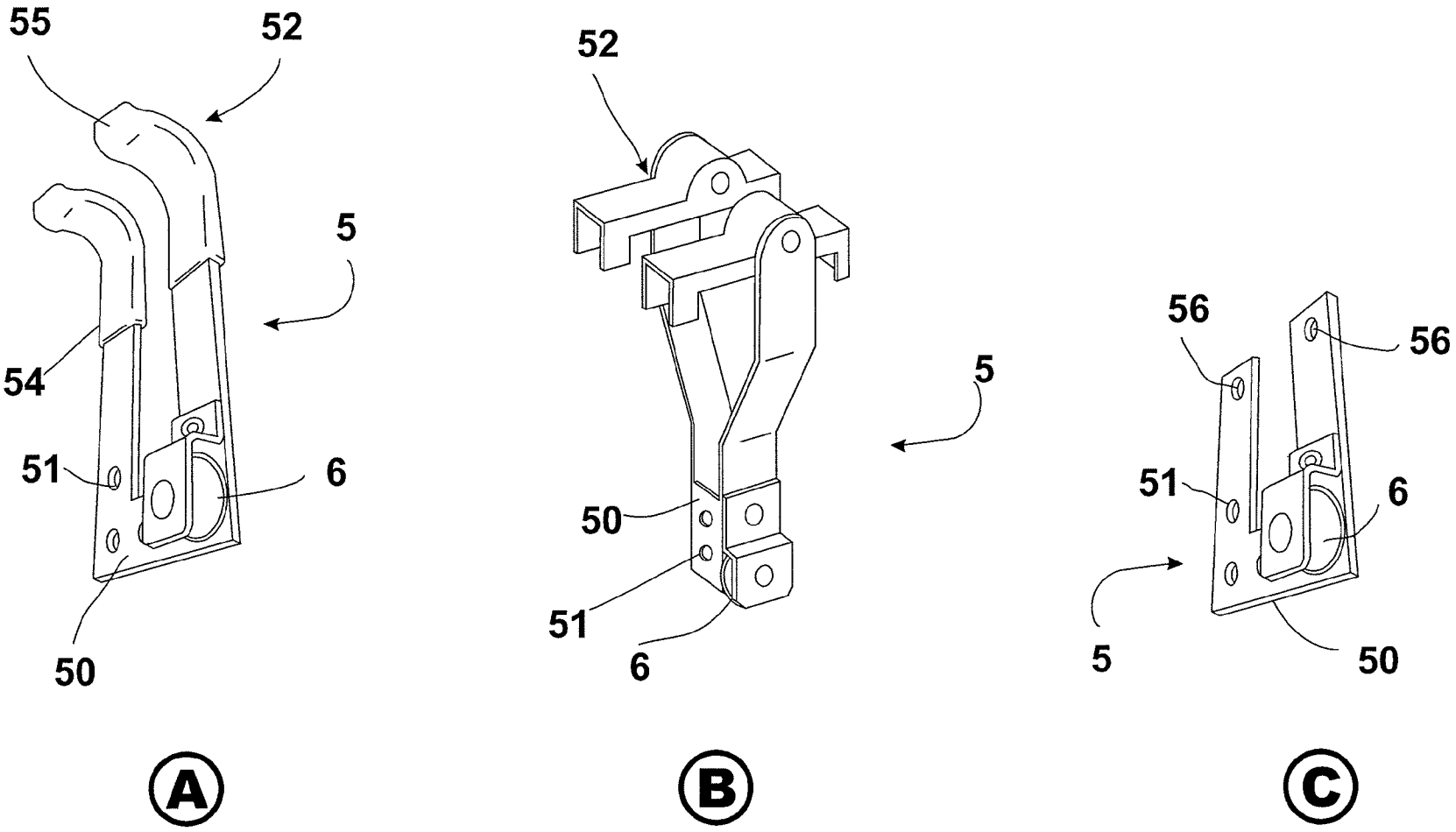
FIG. 8A is a perspective view of the fastening support, in an embodiment wherein it forms a hook.
FIG. 8B is a perspective view of the fastening support in another embodiment wherein it forms two coupling ends.
FIG. 8C is a perspective view of the fastening support in another embodiment wherein the ends may be placed, removed or changed.
Figure 9:
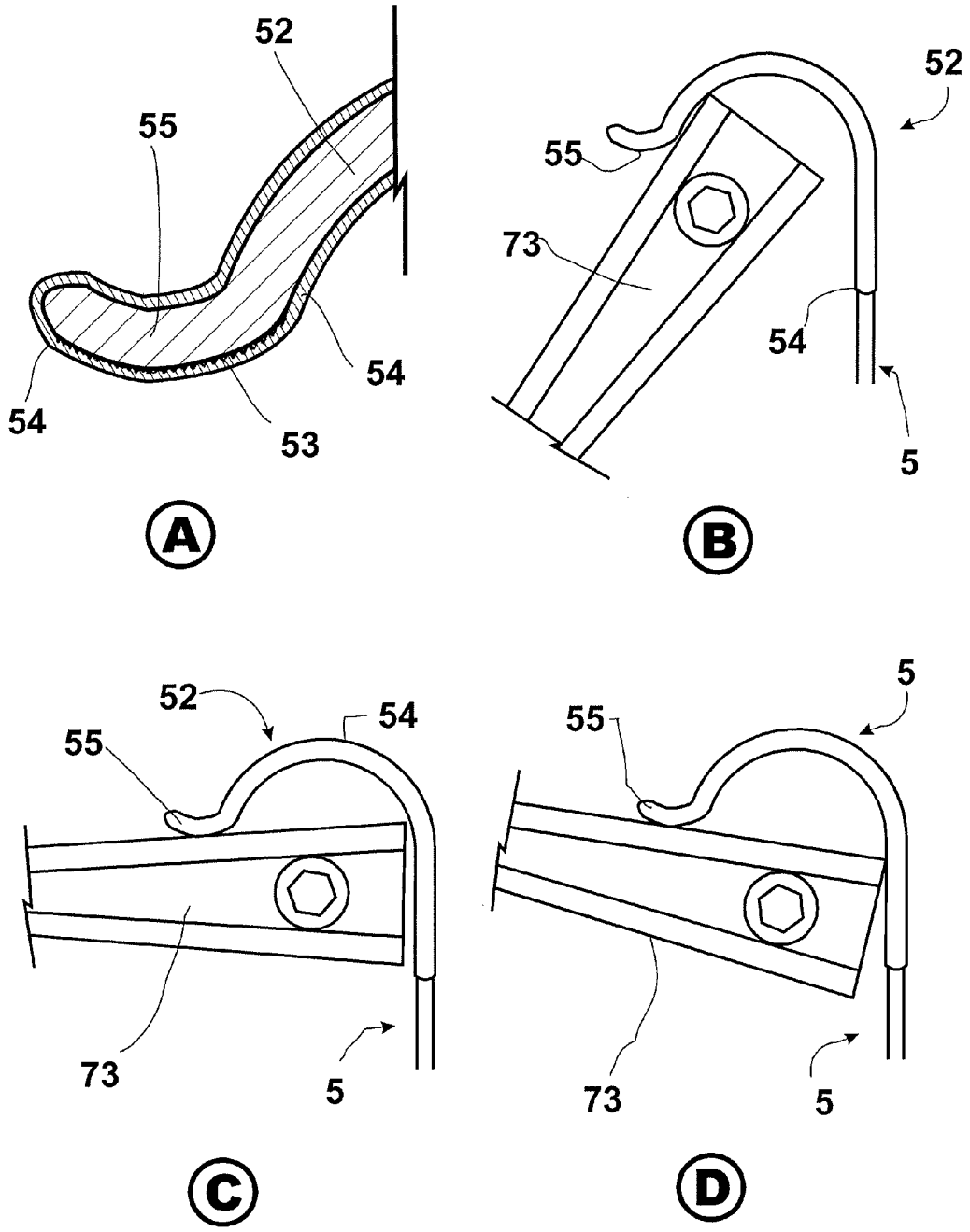
FIG. 9A is a partial longitudinal section of the end of the fastening support in an embodiment wherein it has an anti-slip cover.
FIG. 9B is a side, elevated view of the end of the fastening support applied to a compressed end of a bow.
FIG. 9C is a side, elevated view of the end of the fastening support applied to an end that has been compressed until reaching a position in which the two limbs of the bow remain parallel.
FIG. 9D is a side, elevated view of the end of the fastening support applied to an end that has been compressed until reaching a position wherein the two limbs of the bow exceed the parallel position.
Figure 10:
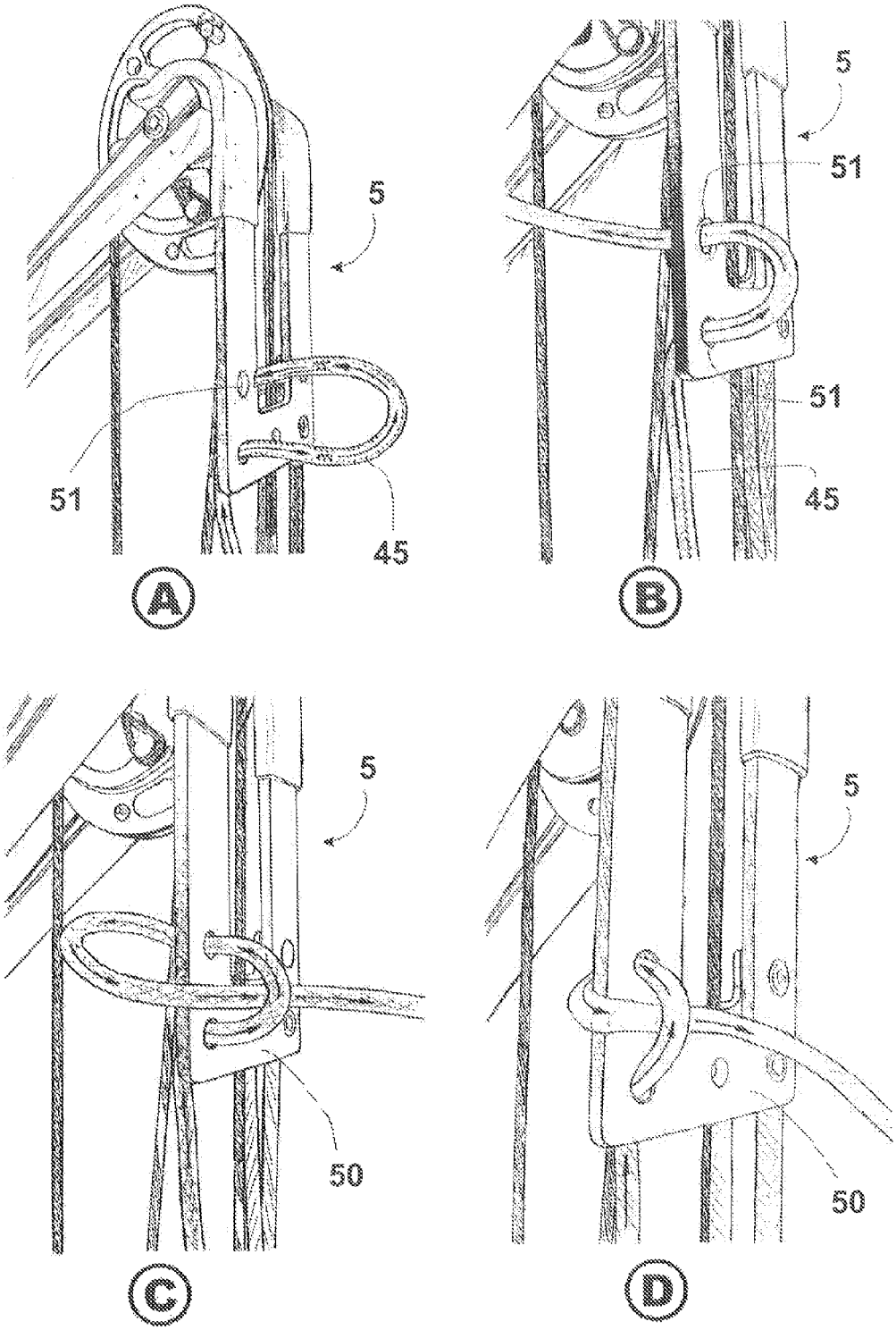

FIGS. 10A-10D show respective perspective views that illustrate a sequence of the tying of the pulling cables in the fastening elements, which are openings in the illustrated embodiment.

DETAILED DESCRIPTION

In general terms, the present invention is related to a portable device to compress bows, which comprises a pulley system (2)(6) with a block and tackle (2) and fixed pulleys (6) which, by means of wirings (3)(4), are connected to a set of fastening supports (5). Fastening ends (52) are prepared to fasten and pull from the ends (73) of the arms or limbs (71) of a bow (7), under the traction influence exerted by the block and tackle (2), which has a drive portion (30) and a brake (26) which control the traction as well as the release of the cables (41)(43) connected to the fastening supports (5).

More particularly, the present device (1) is applicable to simple bows (7) as well as compound bows (7) of the type which comprises a main body (70), a set of limbs (71) ending in double ends (73), sets of pulleys (72) rotatingly mounted between said double ends (73), cables (74) connected to said pulleys (72) and arrow bowstring (75).

This device (1) comprises a set of fastening supports (5) which enable the link of the device (1) with the ends (73) wherein the arms or limbs (71) of the application bow (7) end. Different embodiments have been considered with regard to the fastening ends (52) which enable to take said ends (73) of the bow (7). For example, these fastening ends (52) may form hooks, couplings grip elements, etc. It is also possible that said ends (52) include a plurality of anti-slip projections (53). In another embodiment, the fastening ends (52) may include a cover (54) of an anti-slip material that facilitates its immobility with relation to the ends (73) of the bow (7) to which they are applied.

These ends (52) may form a receptor bend ending in an end finger (55). The purpose of the latter (55) is to facilitate its contact and grip with the ends (73) of the bow (7), even in different angular positions.

It is also provided that the main body (50) of the fastening support (5) is prepared—e.g. with connections (56)—for the placement of different interchangeable or accessory fastening ends (52).

On the other hand, the fastening supports (5) have elements (51) that enable the fixation or tightening of the pulling wiring (4) to which it is connected by the system of pulleys (2) (6). These fixation or tightening elements (51) may comprise a set of openings that permit insertion and knotting of the pulling cables (4). For instance, an opening through which the cable (4) passes, and another opening through which it is inserted until knotting or achieving immobility. Incorporating other elements, such as projections, cramps or fastenings apt for the above mentioned effect is also possible.

In the present embodiment, the fastening supports (5) also show fixed pulleys each (6) which comprise the system of pulleys (2) (6) of the device (1). Each of the pulling cables (4) projects itself from one of the fastening supports (5) and passes through the fixed pulley (6) of the other fastening support (5), and then it links to the block and tackle (2) which forms the system of pulleys (2)(6).

In addition, the block and tackle (2) comprises a set of pulleys (20)(27) comprised by a first (20) and a second (27) pulleys provided with sets of wheels (22) each, with their corresponding rotary assemblies (23).

The first pulley (20) comprises a first frame (21) within which, a set of wheels (22) mounts rotationally (23). This first frame (21) has a brake or blockage (26). In this case, the brake or blockage (26) is provided by a V-shaped opening that, at the outlet of the passage formed by the wheels (22), enables the insertion or shim of the drive portion (30). It has been provided the possibility of incorporating other brakes (26) (push-button, trigger, etc.) that perform the same action.

The block and tackle (2) has its own wiring (3) that, from the drive portion (30), comprises:

A first portion (31) that extends from the outer wheel (22) of the first pulley (20) to the outer wheel (22) of the second pulley (27);

A second portion (32) that extends from the outer wheel of the second pulley (27) to the inner wheel (22) of the first pulley (20);

A third portion (33) extending from the inner wheel (22) of the first pulley (20) to the inner wheel (22) of the second pulley (27); and A fourth portion (34) extending from the inner wheel (22) of the second pulley (27) to the second pulling ear (25) of the first pulley (20).

In addition, the first pulley (20) has a first pulling ear (24) that enables its link with the first portion (41) of the first pulling cable (40). The latter (40) passes through the fixed pulley (6) of the upper fastening support (5) and its second portion (42) crosses as far as the fixation or tightening elements (51) of the lower fastening support (5).

Similarly, the second pulley (27) of the block and tackle (2) has a third pulling ear (29) to which the third portion (44) of the second pulling cable (43) is related. The latter (43) passes through the fixed pulley (6) of the lower fastening support (5) and its fourth portion (45) crosses as far as the fastening or tightening elements (51) of the upper fastening support (5).

The device (1) is placed on the bow (7) so that the ends (52) of the fastening supports (5) suitable take the ends (73) of the limbs or arms (71) of the bow (7). In these conditions, upon pulling the drive portion (30), the wiring (3) of the block and tackle (2) will cause the approach between the first (20) and the second (27) pulleys.

This relative displacement between the pulleys (20) (27) of the block and tackle (2) acts on the pulling cables (4) which, through the fixed pulleys (6), will cause the approach between the fastening supports (5).

In turn, said displacement of the fastening supports (5) overcomes the resistance of the arms or limbs (71) of the bow (7), compressing it until reaching the desired level.

Once the desired compressive level is achieved, the brake or blockage (26) of the drive portion (30) is actuated. In the present embodiment, the above mentioned drive portion (30) fits into the V-shaped opening supplied by the first frame (21) of the first pulley (20).

Once the operations with the bow (7) are finished, the drive portion (30) is released from its brake or blockage (26), and is released until the pulley system (2)(6) enables the release of the fastening ends (52) and removal from the fastening supports (5) of the ends (73) of the limbs (71) of the bow (7).

Undoubtedly, upon putting the present invention into practice, modifications may be introduced regarding certain construction details and form, without departing from the invention.

LIST OF MAIN REFERENCES (1) Device.
(2) Block and tackle.
(20) First pulley of the block and tackle (2).
(21) First frame [of the first pulley (20)]
(22) Pulley wheels (20)(27).
(23) Rotary assembly of the pulleys (20)(27).
(24) First pulling ear [of the first pulley (20)].
(25) Second pulling ear [of the first pulley (20)].
(26) Brake or blockage of the drive portion (30).
(27) Second pulley of the block and tackle (2).
(28) Second frame [of the second pulley (27)].
(29) Third pulling ear [of the second pulley (27)].
(3) Block and tackle wiring.
(30) Drive portion.
(31) First portion of the wiring (3).
(32) Second portion of the wiring (3).

(33) Third portion of the wiring (3).
(34) Fourth portion of the wiring (3).
(4) Pulling wiring.
(40) First pulling cable.
(41) First portion [of the first pulling cable (40)].
(42) Second portion [of the first pulling cable (40)].
(43) Second pulling cable.
(44) Third portion [of the second pulling cable (43)].
(45) Fourth portion [of the second pulling cable (43)].
(5) Fastening supports.
(50) Main body of the fastening support (5).
(51) Fixation or tightening elements.
(52) Fastening ends.
(53) Anti-slip projection.
(54) Anti-slip cover.
(55) Extreme fastening fingers.
(56) Connections to fastening ends (52).
(6) Pulleys fixed on the fastening supports (5).
(7) Application bow.
(70) Bow main body.
(71) Limbs or arms.
(72) Bow tension pulleys (7).
(73) Ends of the limbs or arms (71).
(74) Bow cables (7).
(75) Arrow bowstring.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A portable device to compress a bow, said bow including a main body, a set of limbs ending in double ends, sets of pulleys rotatingly mounted between said double ends, cables connected to said pulleys, and bowstring, comprising:

a system of pulleys comprising a block and tackle of pulleys linked by cables connected to a set of fastening supports, said fastening supports ending in fastening ends to fasten and pull from the ends of the bow, under the traction influence exerted by said block and tackle, and said block and tackle comprises a drive portion and a brake that control the traction and the release of the cables connected to said fastening supports, wherein the fastening supports comprises a fixed pulley.

2. The portable device to compress a bow according to claim 1, wherein the system of pulleys comprises a block and tackle that includes two sets of pulleys with their corresponding frames.

3. The portable device to compress a bow according to claim 1, wherein the fastening supports comprise fixed pulleys, and the system of pulleys comprises the block and tackle of pulleys and the fixed pulleys, wherein a pulling cable passes through each of the fixed pulleys of the fastening supports, such that the pulling cable utilizes the fixed pulley of the fastening support through which it passes while remaining tied to the other of the fastening supports.

4. The portable device to compress a bow according to claim 1, further comprising two sets of pulleys with frames, wherein one of the frames comprises a brake that blocks the return of the drive portion.

5. The portable device to compress a bow according to claim 4, wherein the brake which blocks the return of the drive portion is a blockage type brake which acts on a flexible cable.

6. The portable device to compress a bow according to claim 1, wherein the fastening support comprises anti-slip ends to contact the bow ends.

7. A portable device to compress a bow, said bow including a main body, a set of limbs ending in double ends, sets of pulleys rotatingly mounted between said double ends, cables connected to said pulleys, and bowstring, comprising:

a system of pulleys comprising a block and tackle of pulleys linked by cables connected to a set of fastening supports, said fastening supports ending in fastening ends to fasten and pull from the ends of the bow, under the traction influence exerted by said block and tackle, and said block and tackle comprises a drive portion and a brake that control the traction and the release of the cables connected to said fastening supports, wherein anti-slip ends form recesses prepared to contact the ends of the bow.

8. A portable device to compress a bow, said bow including a main body, a set of limbs ending in double ends, sets of pulleys rotatingly mounted between said double ends, cables connected to said pulleys, and bowstring, comprising:

a system of pulleys comprising a block and tackle of pulleys linked by cables connected to a set of fastening supports, said fastening supports ending in fastening ends to fasten and pull from the ends of the bow, under the traction influence exerted by said block and tackle, and said block and tackle comprises a drive portion and a brake that control the traction and the release of the cables connected to said fastening supports, wherein the fastening supports comprise a fastener for the cables of the block and tackle.

9. The portable device to compress a bow according to claim 1, wherein the fastening supports comprise a set of hooks.

10. The portable device to compress a bow according to claim 1, wherein the fastening supports comprise a set of couplings.

11. A portable device to compress a bow, said bow including a main body, a set of limbs ending in double ends, sets of pulleys rotatingly mounted between said double ends, cables connected to said pulleys, and bowstring, comprising:

a system of pulleys comprising a block and tackle of pulleys linked by cables connected to a set of fastening supports, said fastening supports ending in fastening ends to fasten and pull from the ends of the bow, under the traction influence exerted by said block and tackle, and said block and tackle comprises a drive portion and a brake that control the traction and the release of the cables connected to said fastening supports, wherein the fastening supports end in anti-slip ends with anti-slip covers.

12. The portable device to compress a bow according to claim 11, wherein the anti-slip ends form a receptor bend ending in an end finger.

13. The portable device to compress a bow according to claim 12, wherein the end finger is oriented towards the outside of the receptor bend, such that it prolongs the contact with the ends of the bow in the different angular positions determined by a degree of folding of said bow.

14. A portable device to compress a bow, said bow including a main body, a set of limbs ending in double ends, sets of pulleys rotatingly mounted between said double ends, cables connected to said pulleys, and bowstring, comprising:

a system of pulleys comprising a block and tackle of pulleys linked by cables connected to a set of fastening supports, said fastening supports ending in fastening ends to fasten and pull from the ends of the bow, under the traction influence exerted by said block and tackle, and said block and tackle comprises a drive portion and a brake that control the traction and the release of the cables connected to said fastening supports, wherein the fastening support comprises a connector for assembly of the fastening ends.

15. A portable device to compress a bow, comprising:

a system of pulleys which comprise a block and tackle of pulleys and a fixed pulley, said block and tackle of pulleys are linked with pulling cables connected to a set of fastening supports, such that said pulling cables utilize the fixed pulley of a fastening support, but remain tied to the another of the fastening supports, said fastening supports ending in fastening ends prepared to fasten and pull from the ends of a bow under the traction influence exerted by said block and tackle, and said block and tackle comprises a drive portion and a brake that control the traction as well as the release of the cables connected to said fastening supports.

* * * * *